US006741183B1

(12) United States Patent
Burnett

(10) Patent No.: US 6,741,183 B1
(45) **Date of Patent: *May 25, 2004**

(54) APPLIANCE HAZARD WARNING DEVICE

(76) Inventor: S. Mark Burnett, 1545 Mound St., Sarasota, FL (US) 34236

( * ) Notice: Subject to any disclaimer, the term of this patent is extended or adjusted under 35 U.S.C. 154(b) by 0 days.

This patent is subject to a terminal disclaimer.

(21) Appl. No.: 10/408,982

(22) Filed: Apr. 8, 2003

Related U.S. Application Data

(63) Continuation-in-part of application No. 10/140,030, filed on May 6, 2002.

(51) Int. Cl.[7] ..... G08B 21/00

(52) U.S. Cl. ..... 340/686.1; 340/686.6; 340/689; 340/545.1; 340/545.6; 134/113

(58) Field of Search ..... 340/686.1, 686.6, 340/689, 545.1, 546, 545.6, 635, 565, 653, 539.23; 134/113; 200/621.45 R, 621.52

(56) References Cited

U.S. PATENT DOCUMENTS 4,278,968 A * 7/1981 Arnett et al. ..... 340/686.6
4,894,643 A 1/1990 Thompson et al.
5,070,319 A * 12/1991 Scuka ..... 340/388.4
5,151,884 A 9/1992 Griffith et al.
5,341,123 A * 8/1994 Schuman et al. ..... 340/546
5,479,152 A 12/1995 Walker et al.
5,856,781 A 1/1999 Michel et al.
6,023,887 A 2/2000 Okubo
6,028,520 A * 2/2000 Maehre ..... 340/573.1
6,118,375 A * 9/2000 Duncan ..... 340/541
6,225,904 B1 * 5/2001 Jaffe et al. ..... 340/545.6
6,295,004 B1 * 9/2001 Burnett ..... 340/686.1

* cited by examiner

*Primary Examiner*—Anh V. La
(74) *Attorney, Agent, or Firm*—Charles J. Prescott

(57) ABSTRACT

A pre-injury contact warning device for a front door of an automatic dishwasher or oven, the front door being openable to a generally horizontal very low position above the floor. In one embodiment, the device includes a housing attachable to a surface of the front door. A warning signal emitter sensorially perceptible by a person receives electric power from a miniature storage battery mounted within the housing. An angle-sensitive switch mounted in the housing is operably interconnected between the warning signal emitter and a proximity sensor. The switch is open and the proximity sensor and the warning signal emitter off when the front door is closed, while the switch is closed and the warning signal emitter is armed and on standby when the front door is open. When a person gets within a predetermined distance from the open door, the proximity sensor activates the warning signal emitter. The warning signal emitter, when on, is sufficiently sensorially perceivable to warn or alert the person nearby the dishwasher that the front door is open and to be avoided.

13 Claims, 2 Drawing Sheets

APPLIANCE HAZARD WARNING DEVICE

CROSS-REFERENCE TO RELATED APPLICATIONS

This is a continuation-in-part of Ser. No. 10/140,030 filed May 6, 2002.

STATEMENT REGARDING FEDERALLY SPONSORED RESEARCH OR DEVELOPMENT

Not applicable

INCORPORATION-BY-REFERENCE OF MATERIAL SUBMITTED ON A COMPACT DISC

Not applicable

BACKGROUND OF THE INVENTION

1. Field of the Invention

This invention relates generally to kitchen appliances having an openable front door, and more particularly to a sensorially perceivable hazard-warning device advising persons standing and working nearby the kitchen appliance that the front door is open and represents an injury inducing obstruction.

2. Description of Related Art

Kitchen appliances such as dishwashers and ovens have front doors which are openable by a pivotally downward and outward movement so that the open front door comes to rest in a generally horizontal orientation above the floor. The typical height of these open front doors is in the vicinity of the shin or lower leg of a typical adult person, e.g. in the range of 8" to 12" in height.

When these front doors are in the open position and being as low in relation to the floor as they typically are, a person working in the kitchen about the appliances either loading or unloading food from an oven or dishes from a dishwasher, can easily lose track or awareness of such open front doors. In these circumstances, the likelihood of running a lower leg or shin into or hitting one of the margins of the front door is greatly increased.

Applicant is a medical doctor specializing in dermatological care and routinely treats patients who have injured a shin or lower leg having inadvertently struck the open front door of a dishwasher or oven. More typically, dishwasher-related injuries are involved because the front door of a typical dishwasher is somewhat lower to the floor than the front door of a typical oven.

Applicant has taken an informal poll of approximately 1000 patients which have visited his office for their general skin care. Of those 1000 patients, over half have sustained leg trauma of which about 45% have incurred a leg injury causing skin damage or bruising and/or of sufficient severity to require professional medical attention. One such patient developed cutaneous cancer within two weeks of incurring such an injury which required surgery for removal of the cancerous tissue and an extended period of follow-up care and healing.

There appears to be no significant prior art which has, in any way, addressed this safety issue regarding open front doors of kitchen appliances such as dishwashers and ovens. An appliance door alarm apparatus invented by Thompson and disclosed in U.S. Pat. No. 4,894,643 teaches an audible or visual alarm which is actuated upon leaving the front door to the appliance open longer than a preselected time period.

In U.S. Pat. No. 5,151,884, Griffith teaches a control system for an appliance indicator light for timing the amount of time the appliance front door is open after completion of the operational cycle of the appliance.

Prior to my U.S. Pat. No. 6,295,004, no patented or unpatented devices known to applicant addressed the issue of trying to avoid lower leg and shin injury caused by impact with the open front door of a kitchen appliance. The '004 patent teaches such a device both in aftermarket and original manufacture form, which gives persons standing and moving about the kitchen in the vicinity of an open door of an appliance a visual cue of the potential hazard of accidental impact with the open front door. The present invention greatly expands that inventive concept in utilizing the other human sensory attributes of hearing and touch or felt warning devices.

BRIEF SUMMARY OF THE INVENTION

This invention is directed to a pre-injury contact warning device for a front door of an automatic dishwasher or oven, the front door being openable to a generally horizontal very low position above the floor. In one embodiment, the device includes a housing attachable to a surface of the front door. A warning signal emitter sensorially perceptible by a person receives electric power from a miniature storage battery mounted within the housing. An angle-sensitive switch mounted in the housing is operably interconnected between the warning signal emitter and the storage battery. The switch is open and the warning signal emitter off when the front door is closed, while the switch is closed and the warning emitter on when the front door is open. The warning signal emitter, when on, is sufficiently sensorially perceivable to warn or alert the person nearby the dishwasher that the front door is open and to be avoided. Other embodiments are provided which are operatively dependent upon other forms of sensory perception, e.g. sound and touch or feel. A proximity sensor is also provided to serve as a second stage of arming the device before audible or viewable indicia is emitted.

It is therefore an object of this invention to provide a visible hazard warning device which provides a sensorially perceivable pre-contact warning which advises persons on foot working in the vicinity of the appliance that the front door is open and that it represents an accident hazard to lower legs.

It is another object of this invention to provide a warning light device attachable to the openable front door of a kitchen appliance such as a dishwasher or oven which is activated upon opening of the front door and then fully armed by activation of a proximity sensor to provide a sensorially perceivable cue to those working and moving about in the vicinity of the appliance that the front door is open and represents an injury hazard to shins and lower legs.

It is still another object of this invention to provide a perceivable cue to those working and moving about on foot in proximity to a kitchen appliance when the front door of the appliance is in an open position well below normal eye level of those persons which otherwise might be potentially injured by impact of the lower leg with a side or end margin of the open front door.

It is yet another object of this invention to provide a protective bumper along the door margins of appliances to reduce injury to the lower leg upon accidental contact.

It is yet another object to provide the above invention in either appliances with openable front doors at the time of manufacture or as an aftermarket device attachable to an appropriate surface of the existing appliance.

In accordance with these and other objects which will become apparent hereinafter, the instant invention will now be described with reference to the accompanying drawings.

BRIEF DESCRIPTION OF THE SEVERAL VIEWS OF THE DRAWING(S)

DETAILED DESCRIPTION OF THE INVENTION

Figure 1:
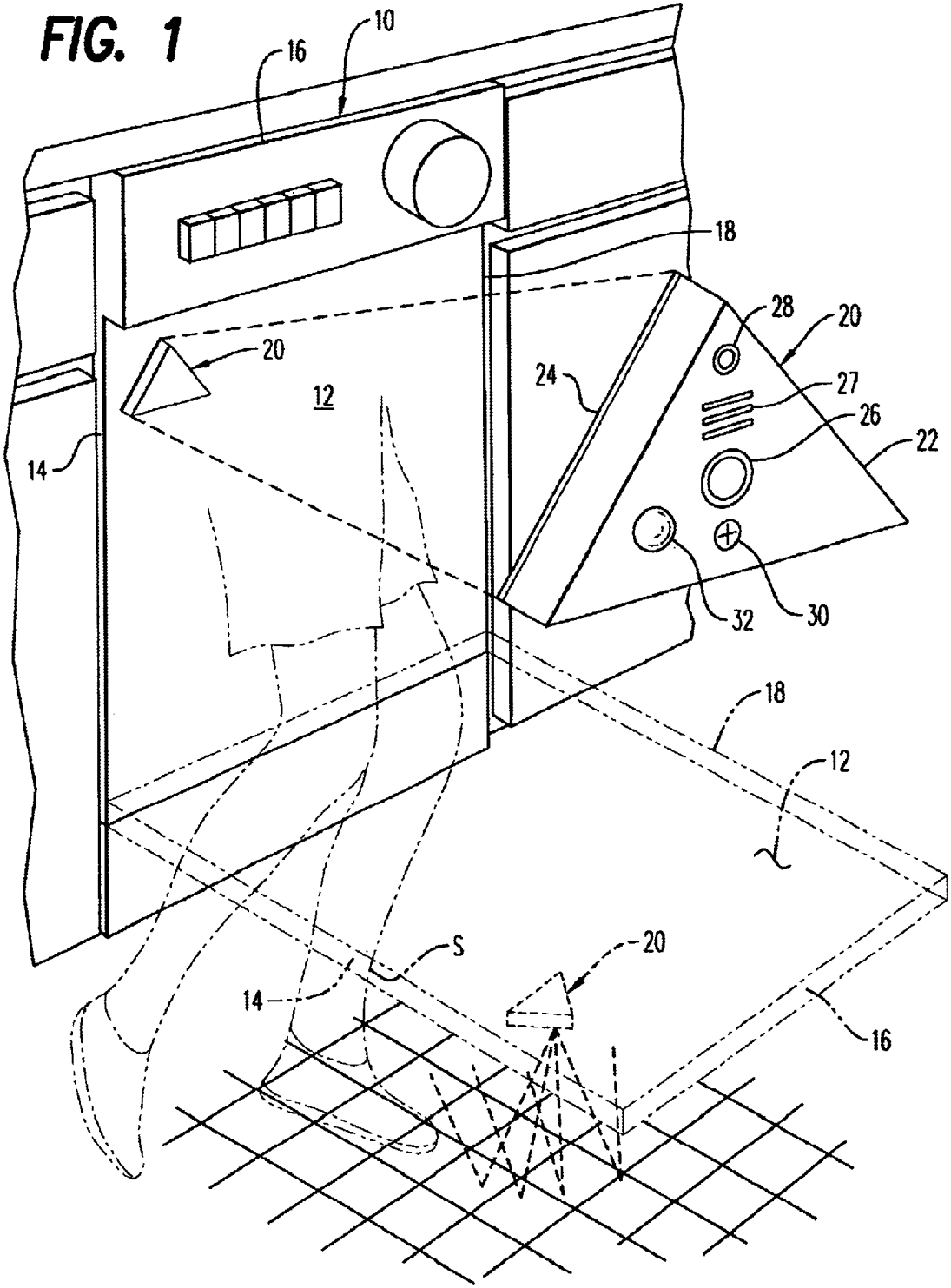
FIG. 1 is an exploded perspective view of the preferred embodiment of the invention in the form of an add-on to a preexisting kitchen dishwasher.

Referring now to the drawings and firstly to FIG. 1, the preferred embodiment of the invention is there shown generally at numeral 20 in conjunction with a kitchen dishwasher shown generally at 10. The dishwasher 10 includes a front door 12 which is pivotally movable from the closed upright position shown in solid lines to the open horizontal position shown in phantom.

When the front door 12 is open as shown in phantom in FIG. 1, each of the side margins 14 and 18 and end or top margin 16 are typically positioned at a height above the floor equal to about the center of the shin or lower leg of an adult person shown in phantom working in the vicinity of the dishwasher 10. Accidental impact as e.g. at S between the shin of the person and one margin, e.g. 14 of the front door 12, is very likely to occur. These accidental injuries occur primarily because the front door 12 is very low to the normal field of vision of a person working in a kitchen and therefore random impact between the lower leg or shin and one of the margins of the front door 12 is very likely to occur.

Applicant, as a physician and surgeon, has examined, treated and taken medical histories for years of patients who had such common lower leg and shin skin wounds and injuries. The injury to the leg by accidental impact of the open front door of the dishwasher 10 or oven appliance, results in skin tears and abrasions which heal very slowly and frequently necessitate medical/surgical attention. Follow-up visits, prescriptions for infection and occasionally surgical treatment typically follow. Moreover, if the patient is older or diabetic, surgery and extensive follow-up treatment are also required.

In this embodiment 12 of the invention, a warning light device 20 is attached as by double-sided adhesive tape to the distal corners of an outer surface of the front door 12. Each of these devices 20 include a "super strobe" LED 28 having a built-in circuit board and which is operably mounted in, and upwardly aimed from, a molded plastic housing 2 having an adhesive surface 24 on the back surface thereof. A loud audible horn or buzzer 27 is also operably connected to the circuit. Two 1.5-volt miniature batteries in series (not shown) are positioned within the housing 22 and are operably connected between the LED 28 and an angle-sensitive switch (not shown) which operably connects the storage battery (not shown) with the LED 28 and to the horn 27 when the device 20 is in the horizontal position shown in FIG. 1. When the front door 12 is in the closed upright position shown in solid lines in FIG. 1, the angle-sensitive switch interrupts electrical power to the LED 28 and to the horn 27. A mute switch 26 is provided to permanently interrupt power delivery to the horn 27. Power to the LED 28 and the horn 27 may be continuous or pulsed as regulated by a rotatable control 30.

As seen in FIG. 1, the LED 28 emits a strong, preferably pulsed stream of light downwardly in the direction of the arrows from a distal corner of the open front door 12 shown in phantom. In the form of a strobe or pulsating light beam and/or sound reflected upward from the floor, the person shown in phantom is much more aware of the fact that the front door 12 is open and the approximate position of the distal corners and associated side margins 14 and 18 and end or upper margin 16 so as to automatically avoid contact and injury between a lower leg and shin and the open front door 12.

In this embodiment 20, a proximity sensor shown at 32 mounted into and extending forward from the front surface of the device 20 is also provided. This proximity sensor 32 is operably connected to serve as a second stage of "on/off" control by only activating the LED 28 and/or the horn 27 when a person, and specifically their lower legs, ankles and feet, come into predetermined proximity of the open dishwasher door 12. The distance between the proximity sensor 32 and some lower limb of the person working around the open door 12 may be preset to activate the LED 28 and/or the horn 27 virtually instantaneously when the person comes within, for example, 24" thereof. Otherwise, the remainder of the system circuitry is on somewhat of a "standby" status as activated by the door position sensor. Only when the proximity sensor 32 is activated will the circuit become fully activated to produce warning light emitted from the LED 28 and/or for sound to be emitted from the horn 27.

Figure 2:
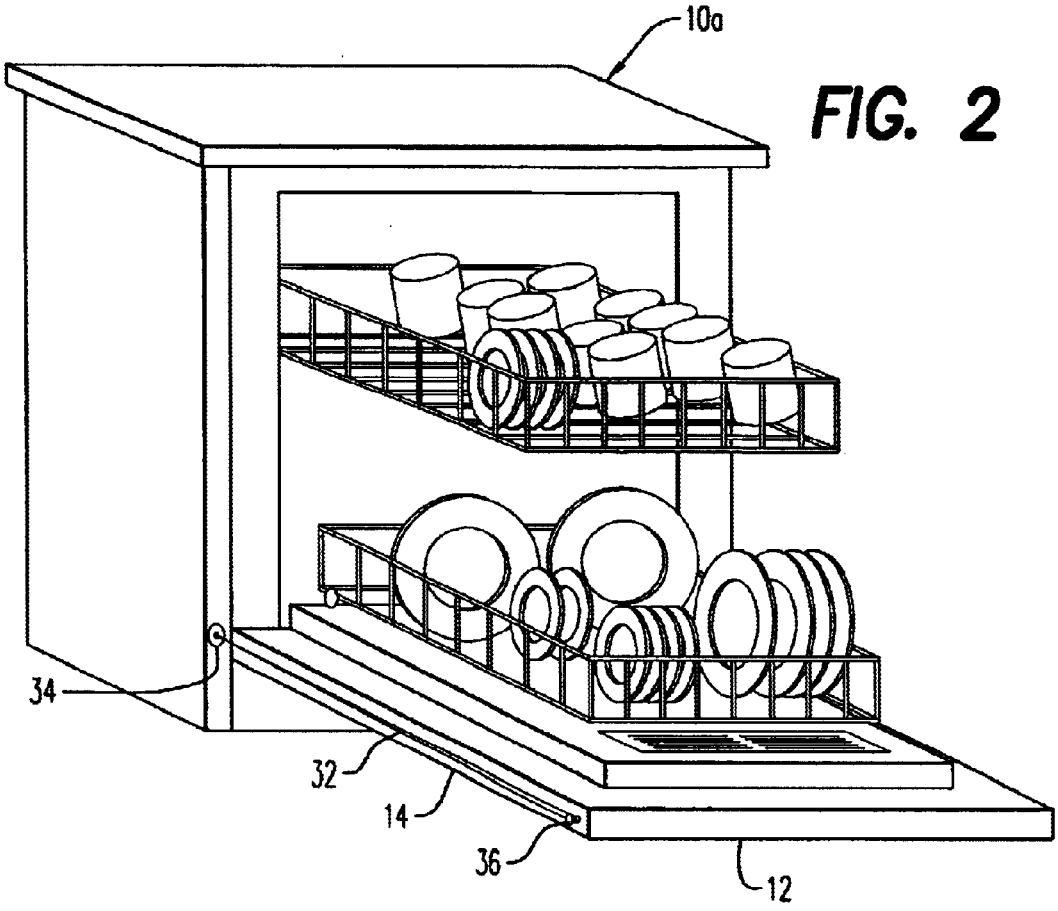
FIG. 2 is a perspective view of a front door of a dishwasher in its open position and incorporating another embodiment of the invention.
Figure 3:
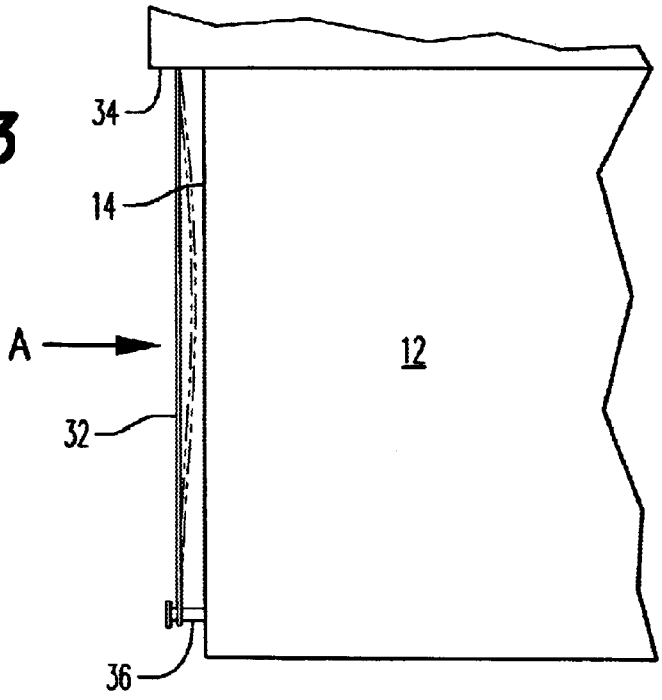
FIG. 3 is a top plan view of a portion of the open front door of FIG. 2.

Referring now to FIGS. 2 and 3, another embodiment of the invention is there shown at numeral **10*a* and includes a front door 12 shown in the open horizontal position. In this embodiment 10*a*, a tensioned string or flexible elastic or inelastic wire 32 extends along a substantial portion of at least one side margin 14. The inner end of the tensioned string 34 is attached to the housing of the dishwasher 10*a*, while the other end of the tensioned string 32 is attached to an offset post 36. By this arrangement, as best seen in FIG. 3, when a person comes in close proximity to the string 32 in the direction of arrow A, a short warning period is provided before shin contact is made with the side margin 14. When the front door 12 is moved to a closed position, the string 32** moves in unison therewith.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A pre-contact warning device for a front door of an automatic dishwasher, the front door being openable to a generally horizontal position above a support surface of the dishwasher when loading and unloading dishes, said device comprising:

a pre-contact sensorially perceivable warning signal emitter;

an activation control which energizes said signal emitter into a standby mode ready to emit a warning signal when the front door is open;

a proximity sensor operably interconnected in said device between said signal emitter and said activation control for activating said signal emitter when the front door is open and a person moves into a predetermined proximity to the front door whereby said warning signal emitter produces a sensorially perceivable warning signal to alert the person in predetermined proximity to the dishwasher that the front door is open and is to be avoided.

2. A pre-contact warning device as set forth in claim 1, wherein:

said warning signal emitter provides a visual queue to the person.

3. A pre-contact warning device attachable to a front door of an automatic dishwasher, the front door being openable to a generally horizontal position above a support surface of the dishwasher when loading and unloading dishes, said device comprising:

a housing attachable to a surface of the front door;

said housing including a pre-contact warning signal emitter and a miniature storage battery mounted within said housing;

an angle-sensitive switch mounted in said housing and operably connected to said storage battery, said switch being open when the front door is closed, said switch being closed when the front door is open;

a proximity sensor operably interconnected between said switch and said warning signal emitter, said proximity sensor activating said warning signal emitter only when the front door is open and a person moves within a predetermined distance from said proximity sensor;

said warning signal emitter, when on, being sufficiently sensorially perceivable to warn or alert a person nearby the dishwasher that the front door is open and is to be avoided.

4. A pre-contact warning device as set forth in claim 3, wherein:

said signal emitter emits visible light;

said housing is structured for attachment to an outside surface of the front door whereby light is reflected upward from the support surface when the front door is open.

5. A pre-contact warning device as set forth in claim 4, wherein:

said signal emitter also emits an audible sound when the front door is open.

6. A pre-contact warning device as set forth in claim 5, wherein:

said signal emitter emits a pulsed and variable signal for enhanced warning discernment by the person.

7. A pre-contact warning device as set forth in claim 3, wherein:

said signal emitter produces sound.

8. An appliance warning device for a front door of an appliance, the front door being openable to a generally horizontal position above a support surface of the appliance, said device comprising:

a pre-contact sensorially perceivable warning signal emitter;

an activation control which energizes said signal emitter into a standby mode ready to emit a warning signal when the front door is open;

a proximity sensor operably interconnected in said device between said signal emitter and said activation control for activating said signal emitter when the front door is open and a person moves into a predetermined proximity to the front door whereby said warning signal producing a sensorially perceivable warning signal sufficient to alert the person in the predetermined proximity to the appliance that the front door is open and is to be avoided.

9. The warning device as set forth in claim 8, wherein:

said warning signal emitter provides a visual queue to the person.

10. An appliance warning device for a front door of an appliance, the front door being openable to a generally horizontal position above a support surface of the appliance, said device comprising:

a housing attached or attachable to an exposed surface of or in close proximity to the front door when closed;

said housing including a pre-contact warning signal emitter;

an angle-sensitive switch mounted in said housing and operably connected to a storage battery, said switch being open when the front door is closed, said switch being closed when the front door is open;

a proximity sensor operably interconnected between said switch and said warning signal emitter, said proximity sensor activating said warning signal emitter only when the front door is open and a person moves within a predetermined distance from said proximity sensor;

said warning signal emitter, when on, being sufficiently sensorially perceivable to warn or alert a person nearby the dishwasher that the front door is open and is to be avoided.

11. The warning device as set forth in claim 10, wherein:

said signal emitter emits visible light;

said housing is structured for attachment to an outside surface of the front door whereby light is reflected upward from the support surface when the front door is open.

12. The warning device as set forth in claim 10, wherein:

said signal emitter emits visual light;

said housing includes a mounting plate pivotally and biasingly connected to said housing, said mounting plate adhesively attachable to a top counter surface in close proximity to a top margin of the front door;

said housing positioned for contact and pivotal movement from the open position to the closed position of said switch as the front door is opened whereby said signal emitter emits light each time the front door is opened.

13. The warning device as set forth in claim 10, wherein:

said signal emitter produces sound.

* * * * *